US006826835B1

(12) United States Patent
Wong

(10) Patent No.: US 6,826,835 B1
(45) Date of Patent: Dec. 7, 2004

(54) ELECTRIC SHAVER

(75) Inventor: John Ying Man Wong, Shatin (HK)

(73) Assignee: Raymond Electric (China) Ltd., Shatin (HK)

( * ) Notice: Subject to any disclaimer, the term of this patent is extended or adjusted under 35 U.S.C. 154(b) by 0 days.

(21) Appl. No.: 10/654,952

(22) Filed: Sep. 5, 2003

(51) Int. Cl.[7] ..... B26B 19/42
(52) U.S. Cl. ..... 30/34.2; 30/43.92
(58) Field of Search ..... 30/34.2, 43.92, 30/346.51

(56) References Cited

U.S. PATENT DOCUMENTS

| | | | | |
|---|---|---|---|---|
| 2,726,442 A | * | 12/1955 | Miller | 30/34.2 |
| 3,191,296 A | * | 6/1965 | Locke | 30/34.2 |
| 3,827,144 A | * | 8/1974 | Arpino | 30/43.92 |
| 4,896,420 A | | 1/1990 | Locke | |
| 5,245,754 A | | 9/1993 | Heintke et al. | |
| 5,398,412 A | | 3/1995 | Tanahashi et al. | |
| 5,564,191 A | | 10/1996 | Ozawa | |
| 5,943,777 A | * | 8/1999 | Hosokawa et al. | 30/34.2 |
| 6,082,005 A | | 7/2000 | Tezuka | |
| 2001/0003870 A1 | | 6/2001 | Eichhorn et al. | |
| 2001/0022026 A1 | * | 9/2001 | Garenfeld et al. | 30/34.2 |

FOREIGN PATENT DOCUMENTS

| | | |
|---|---|---|
| JP | 8-10463 | 1/1996 |
| JP | 9-206483 | 8/1997 |
| JP | 10-43443 | 2/1998 |

* cited by examiner

*Primary Examiner*—Douglas D Watts
(74) *Attorney, Agent, or Firm*—Leydig, Voit & Mayer, Ltd.

(57) ABSTRACT

An electric shaver has two elongate shaving heads extending across an upper end of a body on front and rear sides thereof. Each head has co-operable outer cutting foil and inner shearing cutter. A drive mechanism is located in the upper body end and is in drive engagement with the heads for reciprocating the cutters in opposite directions against the corresponding foils for cutting. Each head has a first part and the upper body end includes a second part, which are in movable engagement with each other such that the head is compressible downwardly to move outwardly from the front/rear side of the body, thereby stretching a user's skin flat to facilitate shaving.

10 Claims, 5 Drawing Sheets

ELECTRIC SHAVER

The present invention relates to an electric shaver and in particular to a reciprocatory shaver.

BACKGROUND OF THE INVENTION

The present market for men or ladies shavers are usually dominated by two main types of shaving system, namely the foil and rotary types. Amongst the foil type shavers, various manufactures produce different combinations of foil and trimmer designs. However, all of these shavers are derived from essentially the same spring-loaded foil system which includes an oscillating cutter that slides against the inner surface of a thin metal cutting foil. The cutter is spring-loaded so that it is kept in contact with the foil at all times. The movement of the foil, from the user's point of view, is a simple up and down movement, facilitated by the same spring that keeps the cutter in contact with the foil.

Some modern shavers offer a variable spring rate that can be regulated by the user to change the spring force, such that the up and down movement of the foil is adjustable to be softer or harder. Thus, the softer the spring is, the gentler the shaver becomes, and vice versa. The longstanding up and down foil movement is not ideal, whether it be adjustable or not, as the natural shaving motion is a smooth gliding action and not a "press in your face" action.

The present invention seeks to mitigate or at least alleviate such a problem by providing an improved electric shaver of this type.

SUMMARY OF THE INVENTION

According to the invention, there is provided an electric shaver comprising an oblong body having upper and lower ends and having front and rear sides, and a pair of elongate shaving heads extending across the upper body end on respective front and rear sides of the body. Each shaving head has an outer cutting foil and an inner shearing cutter co-operable with the foil to perform a cutting action. Also included is a drive mechanism located in the upper body end and in drive engagement with the shaving heads for reciprocating the two shearing cutters in opposite left and right directions against the corresponding cutting foils for cutting. At least a first of the shaving heads has a first part and the upper body end is provided with a second part. The two parts are in movable engagement with each other such that the first shaving head is compressible downwardly to move outwardly from the corresponding one of the front and rear sides of the body, thereby stretching a user's skin flat to facilitate shaving.

Preferably, the movable engagement between the two parts comprises a slidable engagement.

More preferably, the slidable engagement between the two parts is linear and inclined at an acute angle with respect to the body.

Further more preferably, the slidable engagement between the two parts is inclined at an angle of substantially 45° with respect to the body.

In a preferred embodiment, the shearing cutter of the first shaving head includes a base in engagement with the drive mechanism and includes the first part, and the drive mechanism includes the second part in said movable engagement with the first part.

More preferably, the first part has a pair of legs flanking the second part, and each of the legs and the adjacent side of the second part include a protrusion in slidable engagement within a slot to permit the downward and outward movement of the first shaving head.

In a preferred embodiment, the cutting foil of the first shaving head includes the first part and is supported by a fixture which is provided at the upper body end and includes the second part is in said movable engagement with the first part.

More preferably, the cutting foil has opposite ends each providing the first part, the fixture has opposite ends each providing the second part adjacent a respective said first part, and the adjacent first and second parts of each pair include a protrusion in slidable engagement within a slot to permit the downward and outward movement of the first shaving head.

It is preferred that the second shaving head has substantially the same construction as the first shaving head, both shaving heads being compressible downwardly to move outwardly from the corresponding front and rear sides of the body.

In a specific construction, the shearing cutter of each shaving head comprises a row of cutter blades mounted fast on an elongate member that is in turn supported at its mid-length by a spring connected to a base in engagement with the drive mechanism.

BRIEF DESCRIPTION OF DRAWINGS

The invention will now be more particularly described, by way of example only, with reference to the accompanying drawing, in which.

DETAILED DESCRIPTION OF PREFERRED EMBODIMENT

Figure 1:
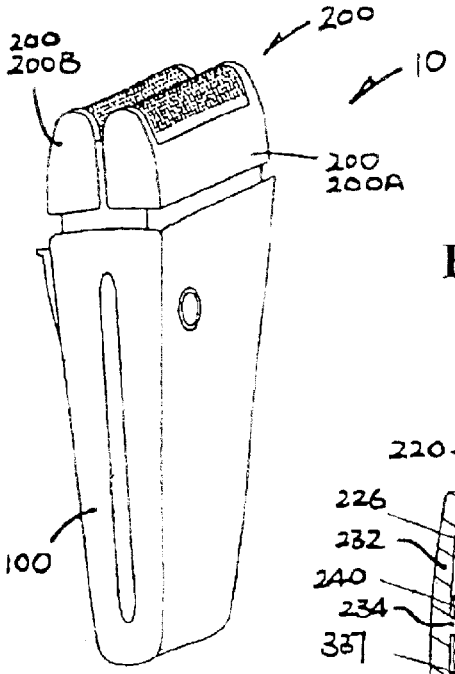
FIG. 1 is a front perspective view of an embodiment of an electric shaver in accordance with the invention.
Figure 2:
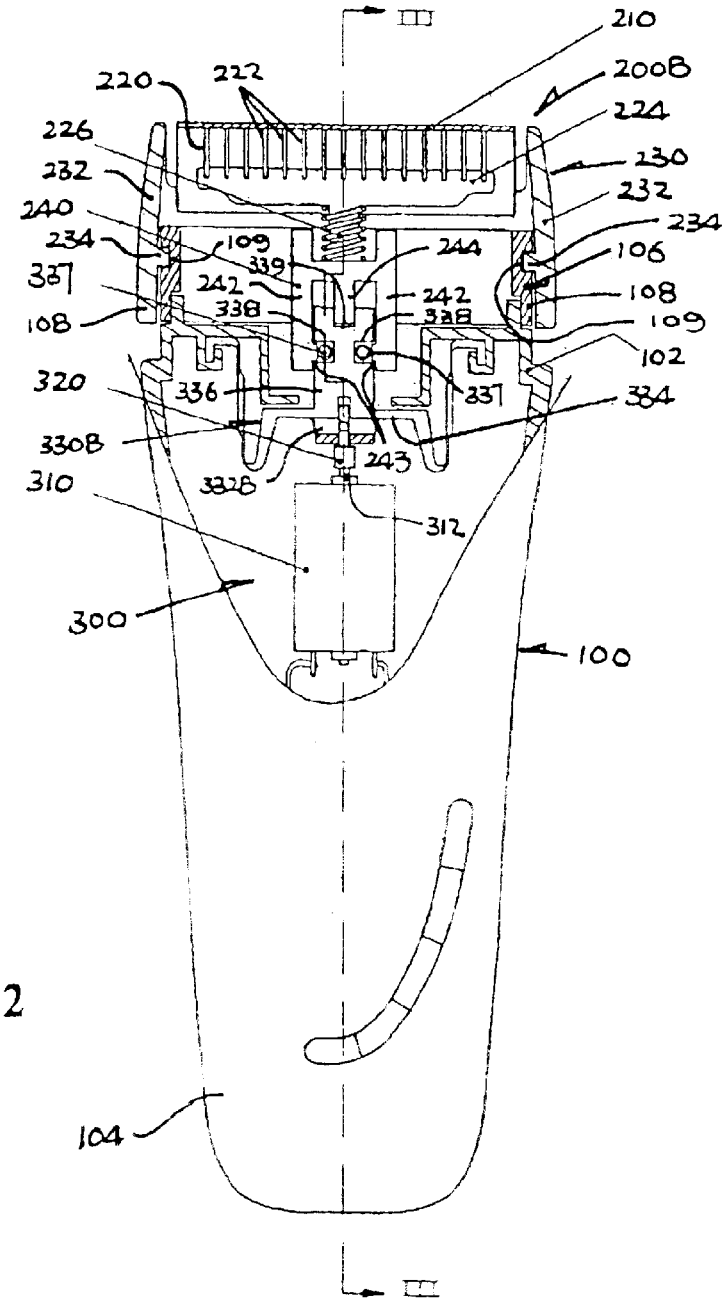
FIG. 2 is a cross-sectional view of the electric shaver of FIG. 1, taken along line II—II of FIG. 3.
Figure 3:
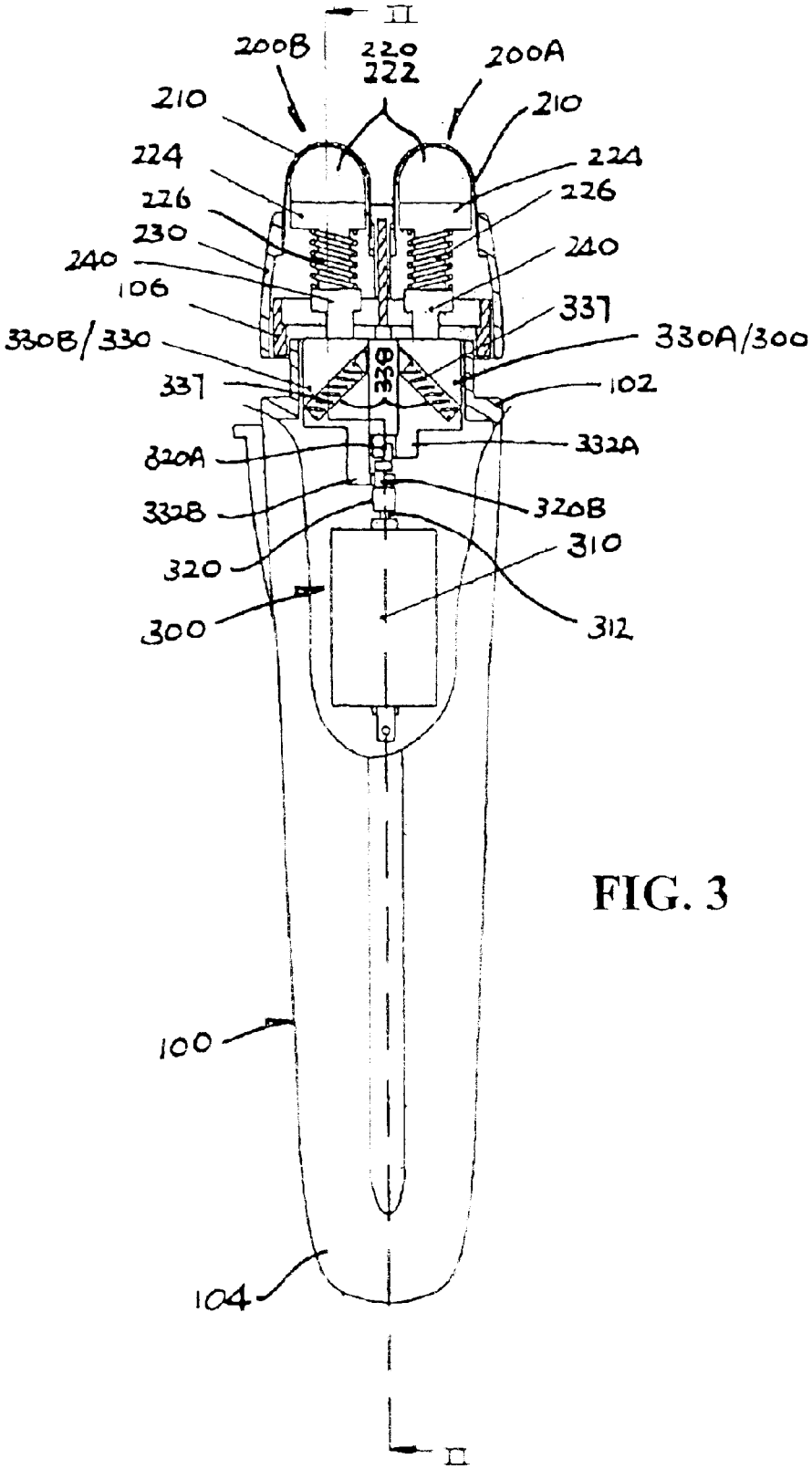
FIG. 3 is a cross-sectional view of the electric shaver of FIG. 2, taken along line III—III.

Referring to the drawings, there is shown a twin-foil wet and dry electric shaver 10 embodying the invention, which has an oblong hollow body 100 having upper and lower ends 102 and 104, and a pair of front and rear elongate shaving heads 200A and 200B (or 200 collectively). The shaving heads 200 co-extend generally horizontally across the upper body end 102. Each shaving head 200 has an outer U-sectioned cutting foil 210 and an inner shearing cutter 220 co-operable with the foil 210 to cut beard or any other body hair, and includes an individual pocket 230 supporting the foil 210, exposing the same, for collecting the cut hair.

The shaver 10 includes a drive mechanism 300 located in the upper body end 102, which supports both shaving heads 200 by their cutters 220. The drive mechanism 300 is operable to reciprocate the two cutters 220 in opposite left and right directions slidingly against the corresponding foils 210 for cutting beard through a shearing action.

The drive mechanism 300 is implemented by an electric motor 310 having a vertical shaft 312, a crank pin 320 mounted fast on the shaft 312 for spinning thereby, and a pair of front and rear oscillators 330A and 330B (or 330 collectively), in engagement with respective cutters 220. The oscillators 330 are driven by the crank pin 320 to slide rapidly in opposite left and right directions.

Upper and lower sections 320A and 320 of the crank pin 320 are eccentric and offset in opposite directions. A bottom part 332A/332B of each oscillator 330A/330B has a laterally extending slot in sliding engagement with the pin section 320A/320B respectively, such that both oscillators 330A and 330B are set into reciprocation upon spinning of the crank pin 320.

Each oscillator 330 includes a laterally elongate base 334 that is supported by the upper body end 102 for lateral sliding movement. Also included is a generally rectangular central block 336 upstanding from the base 334 for supporting a corresponding cutter 220. The left and right faces of the block 336 are formed symmetrically with a pair of side grooves 338 that are straight and inclined at an angle of about 45° across the block's top inner and bottom outer corners as shown, with respect to the shaver body 100. The top face of the block 336 includes a middle groove 339 which extends from back to front and has an inclined bottom parallel to the side grooves 338.

Each cutter 220 is formed by a row of part-circular cutter blades 222 mounted fast on a horizontal bar 224 that is in turn supported at its mid-length by a vertical coil spring 226 connected to a base bracket 240. The spring 226 provides a relatively stiff flexing support for the cutter blades 222 (and bar 224) relative to the base bracket 240.

The base bracket 240 has a generally rectangular shape, having a pair of left and right legs 242 that flanks the oscillator block 336 from above, and including a shorter middle leg 244 that fits slidably within the block's top groove 339. The middle leg 244 has a bottom inclined at an angle of about 45° matching with that of the top groove 339. An integral rib 243, inclined at the same angl of about 45°, on the inner surface of each side leg 242 engages slidably with the side groove 338 on the same side of the block 336.

With this arrangement, each base bracket 240 or the overall cutter 220 is slidable relative to the block 336 or the corresponding overall oscillator 330 in opposite directions, back-to-front and up-and-down, as guided by the sliding engagement inclined at 45° between the grooves 338 and the corresponding ribs 243. A compression coil spring 337 in each groove 338 co-acting between respective opposite ends of the groove 338 and the associated rib 243 resiliently biasses the cutter 200 upwardly and inwardly relative to the corresponding oscillator 330.

An oblong frame 106 is fixed across the upper body end 102, acting as an upward extension thereof and surrounding both base brackets 240. The frame 106 has opposite end plates 108 each having a pair of front and rear grooves 109 that are inclined in opposite directions at the same angle of about 45° as the side grooves 338 on the same side of the two front and rear oscillator blocks 336. Each pocket 230 has opposite end plates 232 each having a rib 234 that is inclined at the same angle of about 45° as the corresponding front or rear groove 109 and is in sliding engagement therewith.

As guided by such sliding engagements at opposite ends, each pocket 230 and the cutting foil 210 fixed thereto are slidable in union with the associated cutter 220 relative to the corresponding oscillator 330 in opposite back-to-front and up-and-down directions. Thus, the cutting foil 210 and the cutter 220 of each shaving head 200 are floating in opposite back-to-front and up-and-down 45° directions, with the cutter 220 laterally slidable by the supporting oscillator 300 against the cutting foil 210 for cutting beard.

Figure 4:
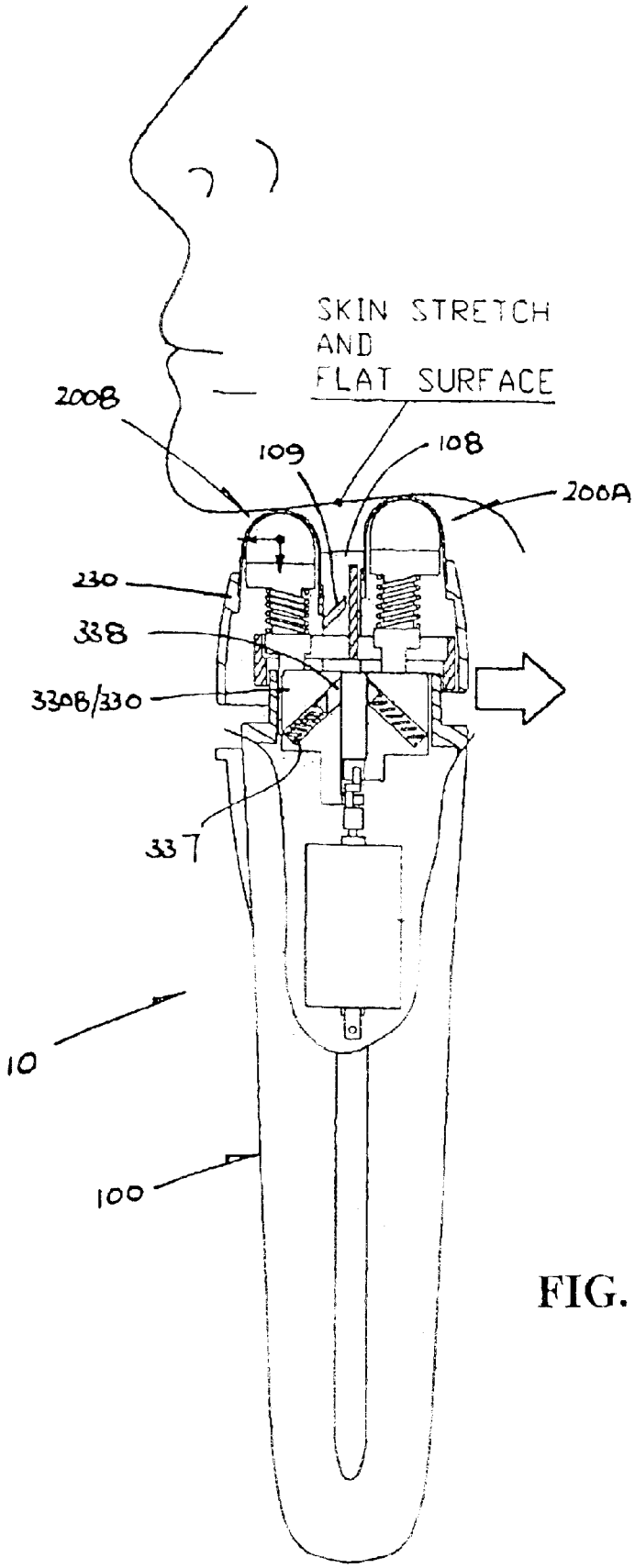
FIG. 4 is a cross-sectional view corresponding to FIG. 3, showing the motion in use of a rear shaving head.
Figure 5:
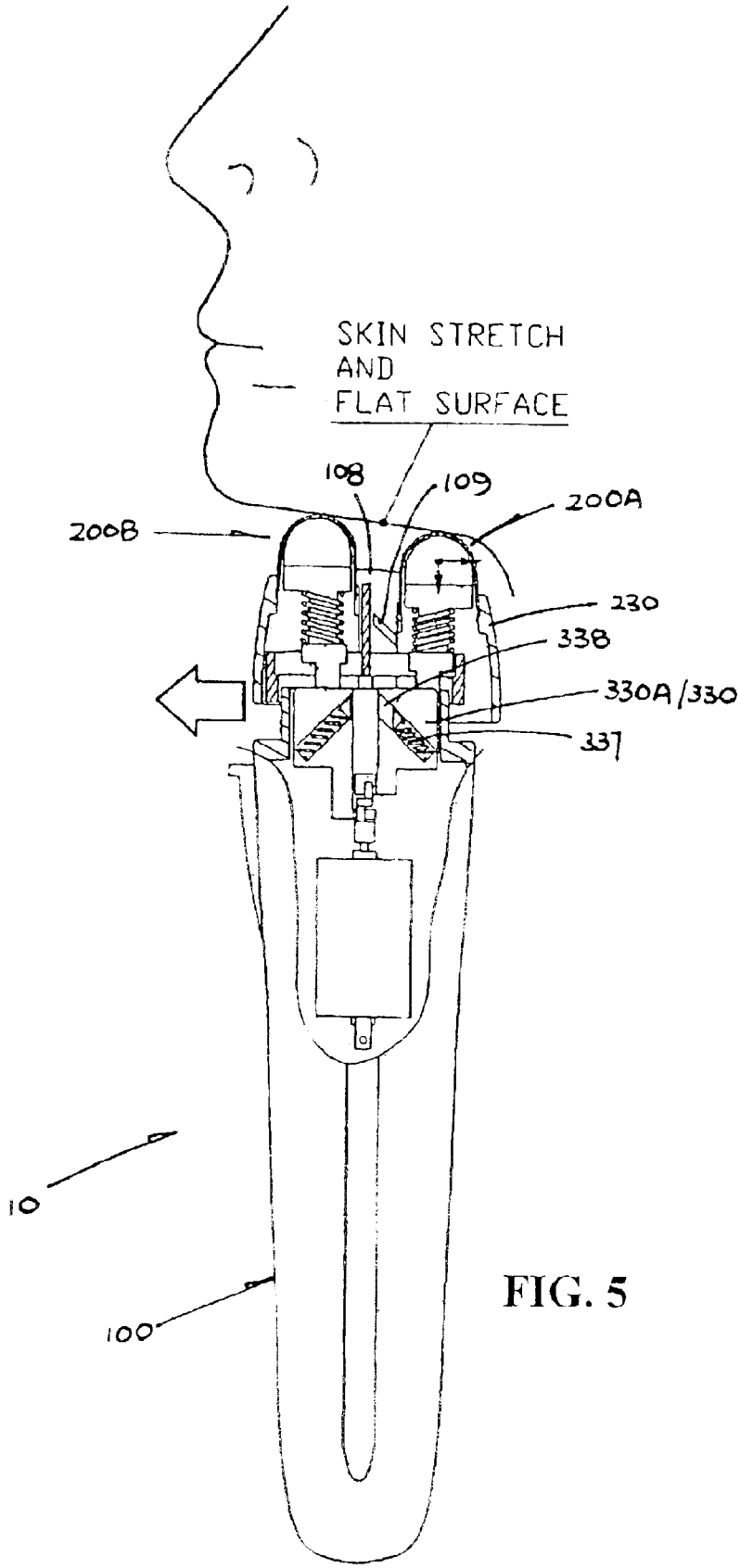
FIG. 5 is a cross-sectional view corresponding to FIG. 3, showing the motion in use of a front shaving head.
Figure 6:
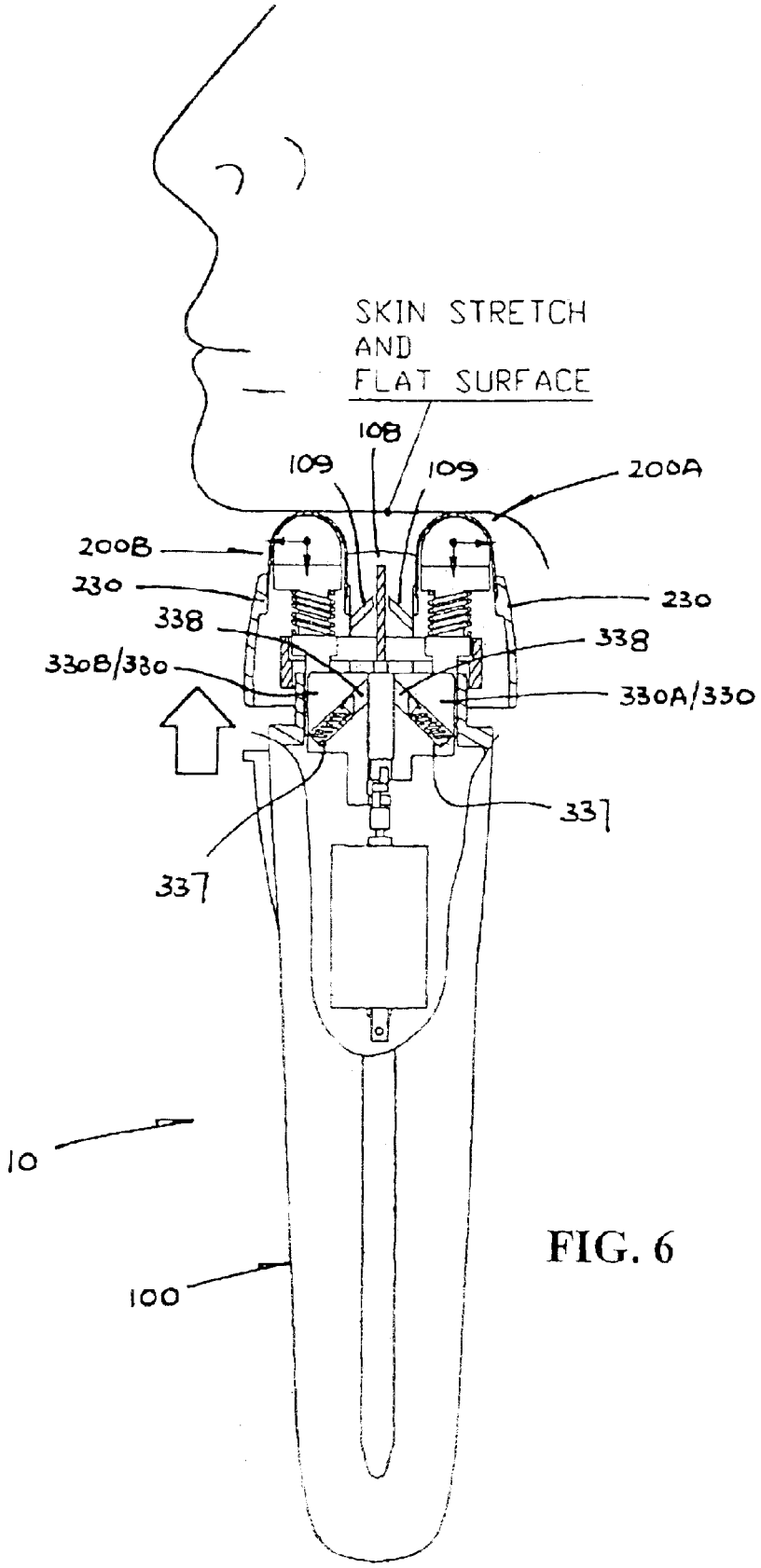
FIG. 6 is a cross-sectional view corresponding to FIG. 3, showing the motion in use of two shaving heads.

With such an arrangement, the front and rear shaving heads 200A and 200B are individually compressible downwardly and simultaneously outwardly (to the front or back respectively) relative to the shaver body 100 as illustrated in FIGS. 4 to 6.

In FIG. 4, the shaver 10 is glided forwards under the chin with the rear shaving head 200B being compressed and thus spread rearwards, whereby the skin between the two shaving heads 200A and 200B is stretched flat to facilitate shaving. In FIG. 5, the same result is achieved by sliding the shaver 10 rearwards whilst compressing and thus spreading the front shaving head 200A forwards. Both shaving heads 200A and 200B may be compressed simultaneously to spread apart and thus stretch the skin between them flat.

It is understood, as is apparent from FIG. 4 or 5, that only one of the shaving heads 200 is required to be movable in the manner as described above in order to stretch skin between the two shaving heads 200. Each shaving head 200 is guided for the described motion at two places, i.e. as between the cutter base 240 and the drive mechanism 300 and between the foil pocket 230 and the body frame 106. For simplicity, it is envisaged that the shaving heads 200 may be guided to move in the same manner at only one of these two places.

The invention has been given by way of example only, and various other modifications of and/or alterations to the described embodiment may be made by persons skilled in the art without departing from the scope of the invention as specified in the appended claims.

What is claimed is:

1. An electric shaver comprising:

an oblong body having upper and lower ends and having front and rear sides;

a pair of elongate shaving heads extending across the upper body end on respective front and rear sides of the body, each having an outer cutting foil and an inner shearing cutter co-operable with the foil to perform a cutting action; and a drive mechanism located in the upper body end and in drive engagement with the shaving heads for reciprocating the two shearing cutters in opposite left and right directions against the corresponding cutting foils for cutting;

wherein at least a first of the shaving heads has a first part and the upper body end is provided with a second part, and the two parts are in movable engagement with each other such that the first shaving head is compressible downwardly to move outwardly from the corresponding one of the front and rear sides of the body, thereby stretching a user's skin flat to facilitate shaving.

2. The electric shaver as claimed in claim 1, wherein the movable engagement between the two parts comprises a slidable engagement.

3. The electric shaver as claimed in claim 2, wherein the slidable engagement between the two parts is linear and inclined at an acute angle with respect to the body.

4. The electric shaver as claimed in claim 3, wherein the slidable engagement between the two parts is inclined at an angle of substantially 45° with respect to the body.

5. The electric shaver as claimed in claim 1, wherein the shearing cutter of the first shaving head includes a base in engagement with the drive mechanism and includes the first part, and the drive mechanism includes the second part in said movable engagement with the first part.

6. The electric shaver as claimed in claim 5, wherein the first part has a pair of legs flanking the second part, and each of the legs and the adjacent side of the second part include a protrusion in slidable engagement within a slot to permit the downward and outward movement of the first shaving head.

7. The electric shaver as claimed in claim 1, wherein the cutting foil of the first shaving head includes the first part and is supported by a fixture which is provided at the upper body end and includes the second part is in said movable engagement with the first part.

8. The electric shaver as claimed in claim 7, wherein the cutting foil has opposite ends each providing the first part, the fixture has opposite ends each providing the second part adjacent a respective said first part, and the adjacent first and second parts of each pair include a protrusion in slidable engagement within a slot to permit the downward and outward movement of the first shaving head.

9. The electric shaver as claimed in claim 1, wherein the second shaving head has substantially the same construction as the first shaving head, both shaving heads being compressible downwardly to move outwardly from the corresponding front and rear sides of the body.

10. The electric shaver as claimed in claim 1, wherein the shearing cutter of each shaving head comprises a row of cutter blades mounted fast on an elongate member that is in turn supported at its mid-length by a spring connected to a base in engagement with the drive mechanism.

* * * * *